US009145881B2

(12) United States Patent
Ishii et al.

(10) Patent No.: US 9,145,881 B2
(45) Date of Patent: Sep. 29, 2015

(54) ELECTROMAGNETIC VIBRATING DIAPHRAGM PUMP

(75) Inventors: Hideki Ishii, Osaka (JP); Tsuyoshi Takamichi, Osaka (JP)

(73) Assignee: TECHNO TAKATSUKI CO., LTD (JP)

( * ) Notice: Subject to any disclaimer, the term of this patent is extended or adjusted under 35 U.S.C. 154(b) by 116 days.

(21) Appl. No.: 14/005,777

(22) PCT Filed: Mar. 15, 2012

(86) PCT No.: PCT/JP2012/056661

§ 371 (c)(1),
(2), (4) Date: Sep. 17, 2013

(87) PCT Pub. No.: WO2012/128169

PCT Pub. Date: Sep. 27, 2012

(65) Prior Publication Data

US 2014/0003978 A1 Jan. 2, 2014

(30) Foreign Application Priority Data

Mar. 22, 2011 (JP) ..... 2011-062187

(51) Int. Cl.
*F04B 43/04* (2006.01)
*F04B 43/02* (2006.01)
(Continued)

(52) U.S. Cl.
CPC ..... *F04B 43/04* (2013.01); *F04B 43/026* (2013.01); *F04B 43/09* (2013.01); *F04B 45/043* (2013.01); *F04B 45/047* (2013.01)

(58) Field of Classification Search
CPC ..... F04B 43/026; F04B 43/025; F04B 43/02; F04B 43/04; F04B 45/043; F04B 45/04; F04B 45/047; F04B 43/09; F04B 43/043; F04B 43/046; F04B 43/06; F04B 45/053; F04B 45/041; F04B 43/023; F04B 43/067; F04B 45/0533; F04B 45/0536; F04B 43/073; F04B 43/0733
USPC ..... 417/395, 413.1, 413.2, 413.3
See application file for complete search history.

(56) References Cited

U.S. PATENT DOCUMENTS 4,123,204 A * 10/1978 Scholle ..... 417/393
5,011,379 A * 4/1991 Hashimoto ..... 417/360

(Continued)

FOREIGN PATENT DOCUMENTS

JP 417826 Y2 4/1992
JP 11264378 A 9/1999

(Continued)

OTHER PUBLICATIONS

International Search Report, App PCT/JP2012/056661 dated Jun. 19, 2012.

(Continued)

*Primary Examiner* — Bryan Lettman
(74) *Attorney, Agent, or Firm* — Perman & Green, LLP

(57) ABSTRACT

An electromagnetic vibrating diaphragm pump is provided with a draining structure which can easily drain water flowed into the pump without a separate member preventing inflow of water. A first communicating passage is formed at a bottom end of a partition wall between a suction chamber and a compression chamber. A bottom portion inside the suction chamber slopes down toward the passage, making its compression chamber side lower than the suction chamber side. A second communicating passage is formed at a bottom end of a partition wall between an exhaust chamber and the compression chamber. A bottom portion inside the compression chamber slopes down toward the passage, making its exhaust chamber side lower than the compression chamber side. A bottom portion inside the exhaust chamber slopes down toward the exhaust port to make the exhaust port side lower. The exhaust port slopes down to make an outlet side thereof lower.

4 Claims, 4 Drawing Sheets

(51) Int. Cl.

| | |
|---|---|
| ***F04B 43/09*** | (2006.01) |
| ***F04B 45/04*** | (2006.01) |
| ***F04B 45/047*** | (2006.01) |

(56) References Cited

U.S. PATENT DOCUMENTS

| | | | | |
|---|---|---|---|---|
| 5,013,223 | A * | 5/1991 | Takahashi et al. | 417/413.1 |
| 5,649,809 | A * | 7/1997 | Stapelfeldt | 417/63 |
| 5,676,531 | A * | 10/1997 | Muscarella et al. | 417/413.1 |
| 6,257,842 | B1 * | 7/2001 | Kawasaki et al. | 417/312 |
| 6,382,935 | B1 * | 5/2002 | Mikiya et al. | 417/413.1 |
| 6,533,560 | B2 * | 3/2003 | Ohya et al. | 417/431 |
| 6,579,074 | B2 * | 6/2003 | Chiba | 417/307 |
| 7,819,642 | B2 * | 10/2010 | Zabar | 417/413.1 |
| 8,128,385 | B2 * | 3/2012 | Takemi | 417/571 |
| 2007/0258835 | A1 * | 11/2007 | Ichiyanagi et al. | 417/413.1 |
| 2012/0020818 | A1 * | 1/2012 | Chen | 417/410.1 |
| 2014/0023533 | A1 * | 1/2014 | Ishii et al. | 417/413.1 |
| 2014/0271274 | A1 * | 9/2014 | Ishii et al. | 417/413.1 |

FOREIGN PATENT DOCUMENTS

| | | | |
|---|---|---|---|
| JP | 2003269339 | A | 9/2003 |
| JP | 2005273477 | A | 10/2005 |
| JP | 2008280970 | A | 11/2008 |
| JP | 3161068 | U | 7/2010 |

OTHER PUBLICATIONS

International Preliminary Report on Patentability, App PCT/JP2012/056661 dated Sep. 24, 2013.

* cited by examiner

ELECTROMAGNETIC VIBRATING DIAPHRAGM PUMP

CROSS-REFERENCE TO RELATED APPLICATIONS

This application is the National Stage of International Application No. PCT/JP2012/056661 International Filing date, 15 Mar. 2012, which designated the United States of America, and which International Application was published under PCT Article 21 (s) as WO Publication 2012/128169 A1 and which claims priority from, and the benefit of, Japanese Application No. 2011-062187 filed 22 Mar. 2011, the disclosures of which are incorporated herein by reference in their entireties.

BACKGROUND

The presently disclosed embodiment relates to an electromagnetic vibrating diaphragm pump, particularly to an electromagnetic vibrating diaphragm pump with a draining structure.

Figure 4:
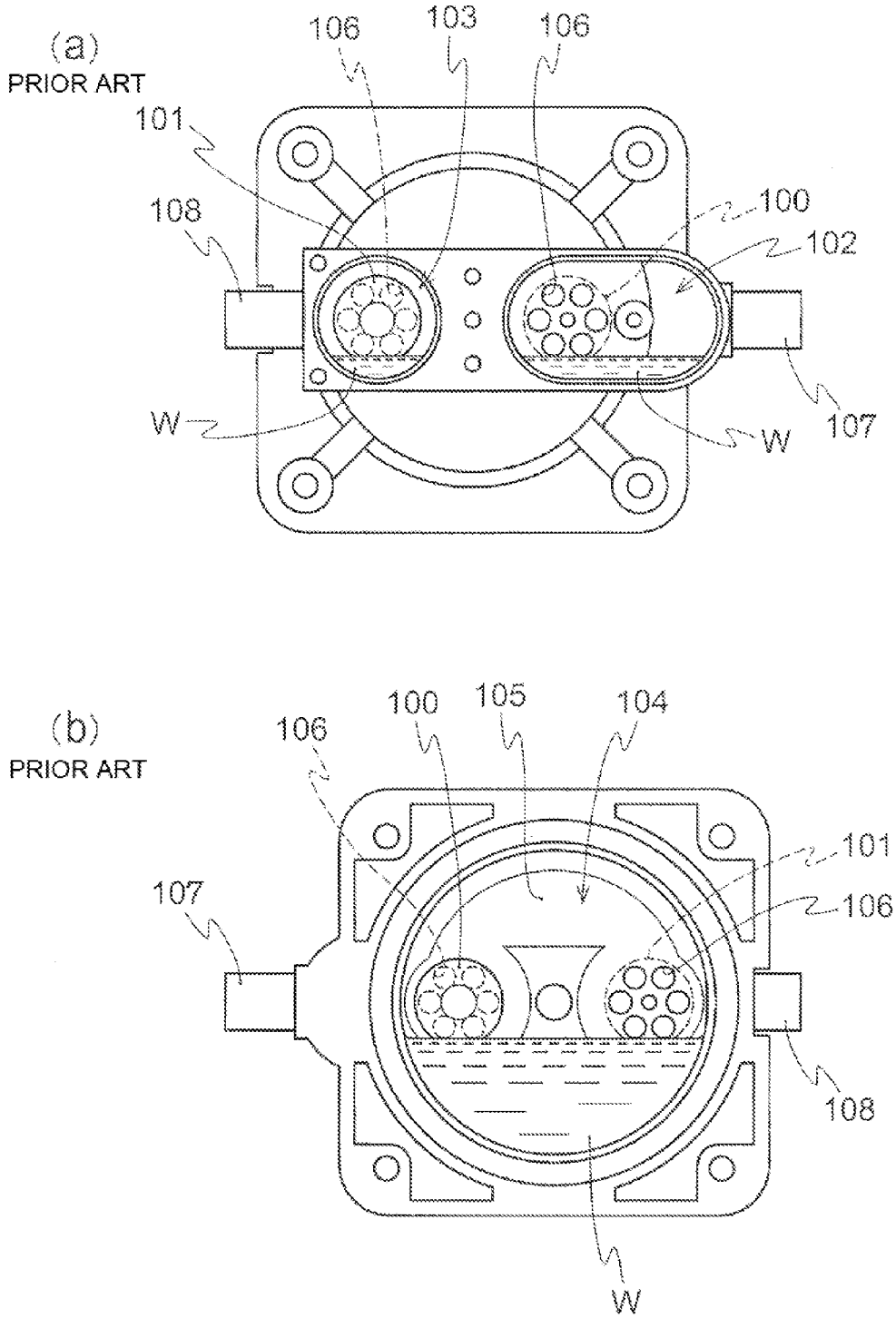

Electromagnetic vibrating diaphragm pumps allowing its pump action to be achieved by a reciprocating motion of an oscillator equipped with a permanent magnet are known as conventional electromagnetic vibrating pumps (See, for example, Patent Documents 1 and 2). In these electromagnetic diaphragm pumps, as shown in FIGS. 4(*a*) and 4(*b*), pump action is achieved in such a manner that air taken in from a suction port 107 firstly enters in a suction chamber 102 and then is supplied, via a suction valve 100, into a compression chamber 104 where the air is compressed by means of a diaphragm (not shown). When a pressure is further applied in the compression chamber 104, the air moves, via an exhaust valve 101, to an exhaust chamber 103 provided with an exhaust port 108 and then is exhausted from the exhaust port 108 of the exhaust chamber 103. In such conventional electromagnetic vibrating diaphragm pump, the suction valve 100 and the exhaust valve 101 are, as shown in FIGS. 4(*a*) and 4(*b*), usually mounted nearly on the center of a partition wall 105 (See FIG. 4(*b*)) partitioning the suction chamber 102, the exhaust chamber 103 and the compression chamber 104, respectively. Communicating passages 106 for connecting the respective chambers for passing a fluid therethrough are formed nearly on the center of the partition wall 105. Additional background information may be found in Japanese publications JP 2005-273477 A and JP 2008-280970 A.

SUMMARY

The conventional electromagnetic vibrating diaphragm pumps having the configuration as mentioned above are, in many cases, located outdoors for the use for purifier tanks, etc., and used in a water-existing environment such as a fish tank, etc. Moreover, there is a case where water comes, via the suction port 107, into the suction chamber 102, the compression chamber 104 and the exhaust chamber 103. This is not limited to the applications mentioned above. In the case of the configuration of conventional electromagnetic vibrating diaphragm pumps, water W remains in the suction chamber 102, the exhaust chamber 103 and the compression chamber 104 as shown in FIGS. 4(*a*) and 4(*b*). If water W remains inside the pump, it causes problems that the members used on the diaphragm pump such as the casing, the diaphragm, the suction valve 100 and the exhaust valve 101 are deteriorated and rusting of fixing parts such as screws for fixing those members arises.

Moreover, once water W comes into the inside of the pump, maintenance is very troublesome because the inside of the suction chamber 102, the exhaust chamber 103 and the compression chamber 104 cannot be seen from the outside in the case of such conventional configuration. Further, when it is found that water remains in a diaphragm pump, the pump itself must be disassembled to remove the water W.

Therefore, in conventional electromagnetic vibrating diaphragm pumps, it cannot be said that measures against water is sufficient, and maintenance is very troublesome when water remains in the pump.

It can be considered to provide a filter for preventing inflow of water into the suction side of an electromagnetic vibrating diaphragm pump so that water does not flow into the pump. However, the number of components increases, which results in problems from the viewpoint of cost and size.

In the light of the above-mentioned problems, an object of the presently disclosed embodiment is to provide an electromagnetic vibrating diaphragm pump equipped with a draining structure which is a simple structure and can easily drain water having flowed into the pump without providing a separate member for preventing inflow of water.

The electromagnetic vibrating diaphragm pump of the presently disclosed embodiment comprises magnetic coil portions connected to an alternating-current power source, an oscillator being equipped with a permanent magnet and being driven so as to make a reciprocating motion by applying an alternating voltage to the magnetic coil portions, diaphragms connected to both ends of the oscillator, and pump casings provided with a suction port and an exhaust port for a fluid, wherein each of the pump casings is provided with a suction chamber provided on an upper side of the pump casing and communicating with the suction port, an exhaust chamber provided on a lower side of the pump casing and communicating with the exhaust port, and a compression chamber communicating with the suction chamber via a suction valve and communicating with the exhaust chamber via an exhaust valve, in which an inside pressure of the compression chamber increases and decreases due to deformation of the diaphragm according to the reciprocating motion of the oscillator, wherein a first communicating passage being provided with the suction valve and communicating between the suction chamber and the compression chamber is formed at a bottom end of a partition wall between the suction chamber and the compression chamber, and a bottom portion inside the suction chamber slopes down toward the first communicating passage such that the compression chamber side thereof is lower than the suction chamber side; a bottom portion of the first communicating passage slopes down such that its compression chamber side is made lower; a second communicating passage being provided with the exhaust valve and communicating between the exhaust chamber and the compression chamber is formed at a bottom end of a partition wall between the exhaust chamber and the compression chamber, a bottom portion inside the compression chamber slopes down toward the second communicating passage such that the exhaust chamber side thereof is lower than the compression chamber side; a bottom portion of the second communicating passage slopes down such that its exhaust chamber side is made lower; and a bottom portion inside the exhaust chamber slopes down toward the exhaust port such that the exhaust port side of the bottom portion is made lower, and the exhaust port slopes down such that an outlet side thereof is made lower.

It is preferable that a concave portion for drainage is formed on a bottom portion inside the suction chamber being adjacent to the first communicating passage.

It is preferable that the suction valve and/or the exhaust valve are arranged such that a clearance is formed between the valve and the partition wall being a valve seat of the suction valve and/or the exhaust valve.

According to the presently disclosed embodiment, a first communicating passage being provided with the suction valve and communicating between the suction chamber and the compression chamber is formed at a bottom end of a partition wall between the suction chamber and the compression chamber, a bottom portion inside the suction chamber slopes down toward the first communicating passage such that the compression chamber side thereof is lower than the suction chamber side, and a bottom portion of the first communicating passage slopes down such that its compression chamber side is made lower; a second communicating passage being provided with the exhaust valve and communicating between the exhaust chamber and the compression chamber is formed at a bottom end of a partition wall between the exhaust chamber and the compression chamber, a bottom portion inside the compression chamber slopes down toward the second communicating passage such that the exhaust chamber side thereof is lower than the compression chamber side, a bottom portion inside the exhaust chamber slopes down toward the exhaust port such that the exhaust port side thereof is made lower, a bottom portion of the second communicating passage slopes down such that its exhaust chamber side is made lower, and the exhaust port slopes down such that an outlet side thereof is made lower. Therefore, even if inflow of water from the suction port occurs, water does not remain inside the diaphragm pump because there is formed a difference in height in a fluid passage of the pump, thereby moving water from the suction chamber to the compression chamber, then from the compression chamber to the exhaust chamber, and further unforcedly draining water in the exhaust chamber from the exhaust port. Accordingly, deterioration of the components and rusting due to the remaining water can be prevented, and maintenance of the inside of the pump is unnecessary. Further, another member such as a filter, etc. for preventing inflow of water is not necessary.

Moreover, by forming a concave portion for drainage on a bottom portion inside the suction chamber being adjacent to the first communicating passage, water coming into the suction chamber is collected on the concave portion for drainage and can be drained efficiently from the exhaust port.

Moreover, by providing a clearance between the valve and the partition wall being a valve seat of the suction valve and/or the exhaust valve, water can be drained from the clearance between the valve and the valve seat even during shut down of the pump.

BRIEF DESCRIPTION OF THE DRAWINGS (FIG. 1) A longitudinal cross-sectional view of the electromagnetic vibrating diaphragm pump of the presently disclosed embodiment.

Figure 1:
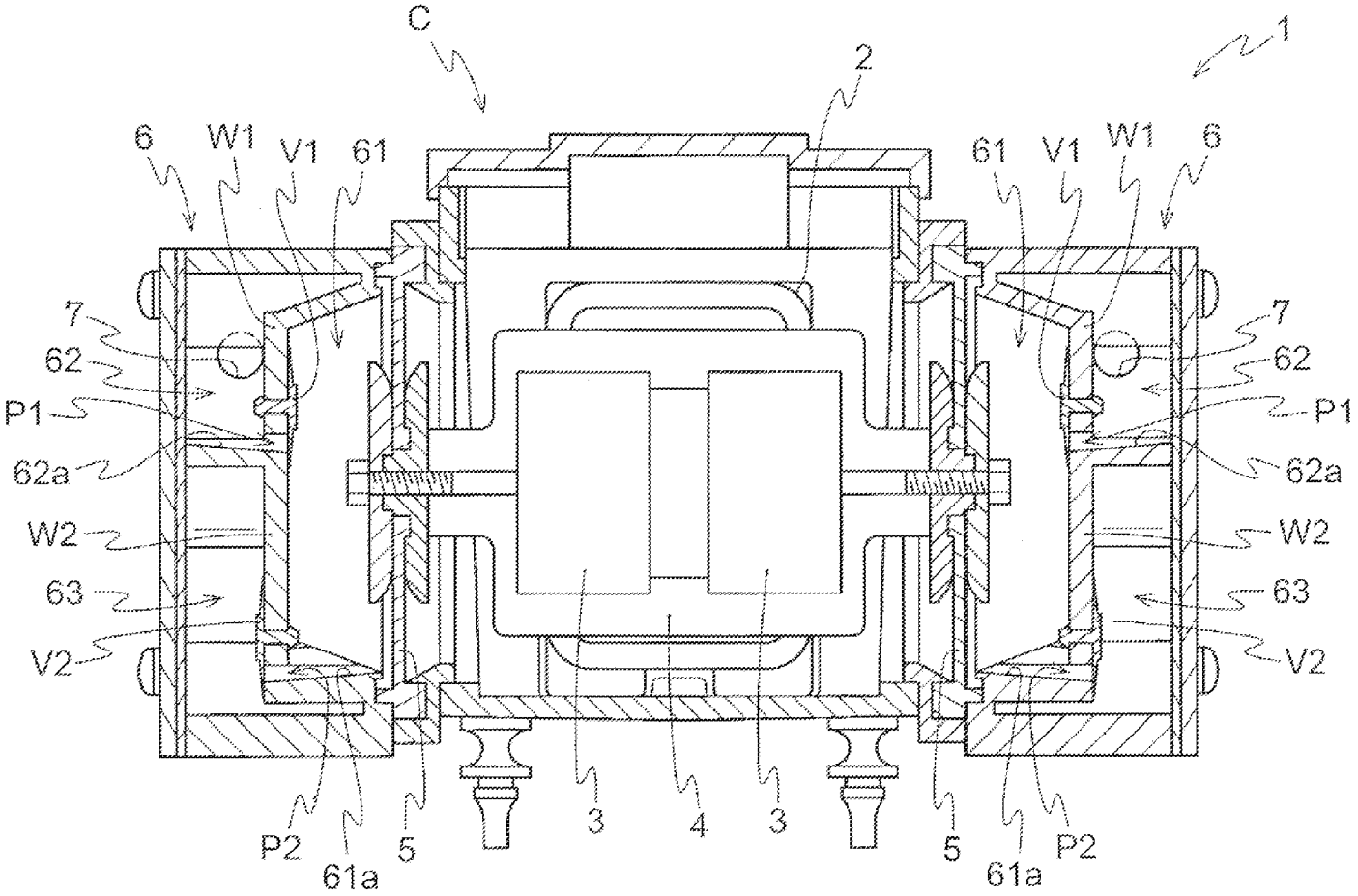

(FIG. 2) A cross-sectional view of A-A line of FIG. 1.

(FIG. 3) A partial cross-sectional view for explaining the structure of the valve to be used in the presently disclosed embodiment.

(FIG. 4) (a) and (b) are views for explaining a conventional electromagnetic vibrating pump.

DETAILED DESCRIPTION

The electromagnetic vibrating diaphragm pump of the presently disclosed embodiment is explained below in detail by referring to the attached drawings. FIG. 1 is a longitudinal cross-sectional view of the electromagnetic vibrating diaphragm pump of the presently disclosed embodiment. As shown in FIG. 1, in the electromagnetic vibrating pump 1 of the presently disclosed embodiment (hereinafter referred to simply as pump 1), a pair of electromagnetic coil portions 2 is provided in a casing C, and an oscillator 4 having permanent magnets 3 is provided between the pair of electromagnetic coil portions 2. At both ends of the casing C, a pair of pump casings 6 is provided, and the inside of the casing C is separated from the pump casings 6 by means of a pair of diaphragms 5 provided on the right and left sides in FIG. 1.

The electromagnetic coil portions 2 are connected with an alternating-current power source, and when the alternating voltage is applied to the electromagnetic coil portions 2, the oscillator 4 provided with the permanent magnets 3 is driven so as to make a reciprocating motion. The diaphragms 5 are connected to both ends of the oscillator 4 and a periphery of the diaphragms 5 is supported by the casing C. In FIG. 1, as the oscillator 4 moves right and left, the pair of diaphragms 5 also deflects right and left to increase and decrease the inside pressure of the compression chamber 61 in the pump casing 6, thereby operating the pump. Here, the configuration of the electromagnetic coil portions 2, the permanent magnets 3, the oscillator 4 and the diaphragms 5 is not limited particularly, and conventional configuration having been used on diaphragm pumps can be used as it is. It goes without saying that improvements over conventional configuration being obvious to a person having ordinary skill in the art are also included in the presently disclosed embodiment.

Figure 2:
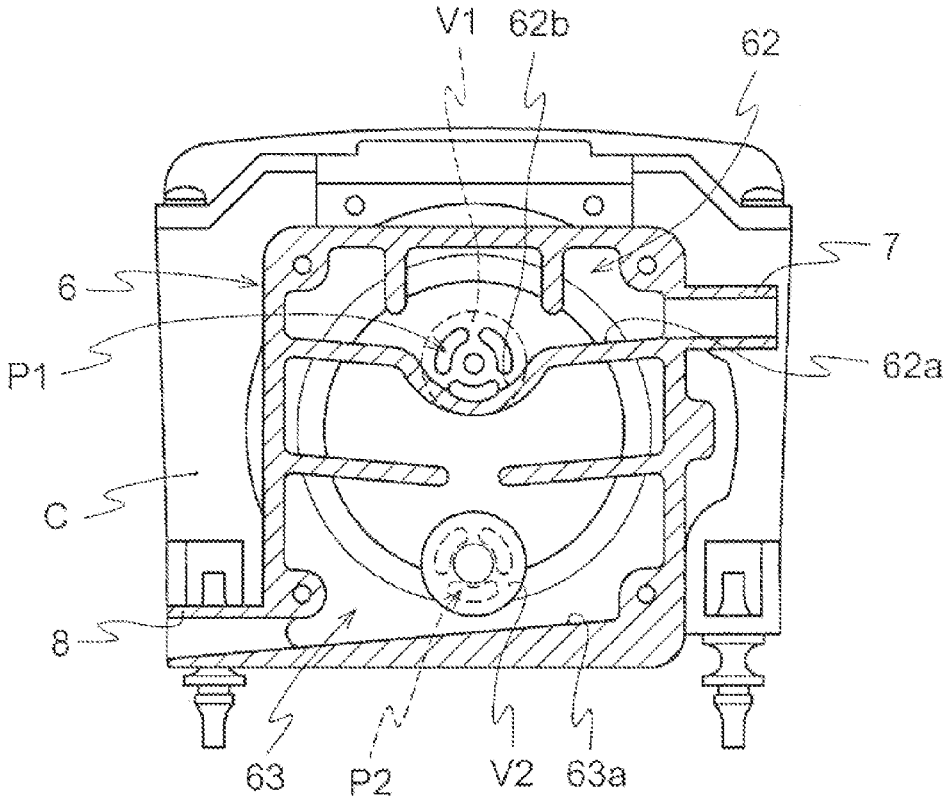

As shown in FIG. 1 and FIG. 2, the pump casings 6 comprise the suction chamber 62 provided with the suction port 7 for taking a fluid such as air thereinto from the outside, the compression chamber 61 into which the fluid flows from the suction chamber 62 through the first communicating passage P1, and the exhaust chamber 63 into which the fluid flows from the compression chamber 61 through the second communicating passage P2 and which is provided with the exhaust port 8 for feeding the fluid toward the outside.

As shown in FIG. 1 and FIG. 2, the first communicating passage P1 is provided with the suction valve V1 to prevent a backflow of the fluid from the compression chamber 61 into the suction chamber 62, and the second communicating passage P2 is provided with the exhaust valve V2 to prevent a backflow of the fluid from the exhaust chamber 63 into the compression chamber 61. As far as a backflow of the fluid can be prevented, materials and structures of the suction valve V1 and the exhaust valve V2 are not limited particularly, and for example, an umbrella valve made of an elastic material can be used.

As shown in FIG. 1 and FIG. 2, the suction chamber 62 is provided on the upper side of the pump casing 6. The first communicating passage P1 communicating between the suction chamber 62 and the compression chamber 61 is provided at the bottom end of a substantially vertical partition wall W1 separating the suction chamber 62 from the compression chamber 61. A bottom portion 62*a* inside the suction chamber 62 slopes down toward the first communicating passage P1 such that the first communicating passage side thereof is made lower, and a bottom portion of the first communicating passage P1 slopes down such that the compression chamber 61 side thereof is lower than the suction chamber 62 side. As mentioned above, by inclining the suction chamber 62 and the first communicating passage P1, water flowing from the suction port 7 into the suction chamber 62 can be collected in the first communicating passage P1, and further, water collected in the first communicating passage P1 can be drained into the compression chamber 61.

The second communicating passage P2 provided with the exhaust valve V2 and communicating between the compression chamber 61 and the exhaust chamber 63 is provided at a bottom end of a substantially vertical partition wall W2 separating the compression chamber 61 from the exhaust chamber 63. A bottom portion 61*a* of the compression chamber 61 is arranged at a position lower than the bottom portion of the first communicating passage P1. The bottom portion 61*a* slopes down toward the second communicating passage such that the second communicating passage side thereof is made lower. As mentioned above, by inclining the compression chamber 61 and the second communicating passage P2, water flowing from the suction chamber 62 into the compression chamber 61 can be collected in the second communicating passage P2, and further, water collected in the second communicating passage P2 can be drained into the exhaust chamber 63.

As shown in FIG. 2, a bottom portion 63*a* of the exhaust chamber 63 slopes down toward the exhaust port 8 such that the exhaust port 8 side thereof is made lower. Also, the exhaust port 8 slopes down so that the outlet side thereof is made lower. Therefore, by inclining the exhaust chamber 63 and the exhaust port 8, water flowing into the exhaust chamber 63 from the compression chamber 61 can be drained from the exhaust port 8.

As mentioned above, by inclining the bottom portion 62*a* of the suction chamber 62, the first communicating passage P1, the bottom portion 61*a* of the compression chamber 61, the second communicating passage P2, the bottom portion 63*a* of the exhaust chamber 63, and the exhaust port 8, thereby providing a difference in a height, water flowing from the suction port 7 can be fed up to the exhaust port by means of a gravity, and therefore, water does not remain inside the pump. Accordingly, it is possible to prevent deterioration of the members to be provided inside the pump casings 6 and generation of rusting of metal fixing means such as screws inside the pump casings 6, which arise due to the remaining water in the pump casings 6.

Figure 3:
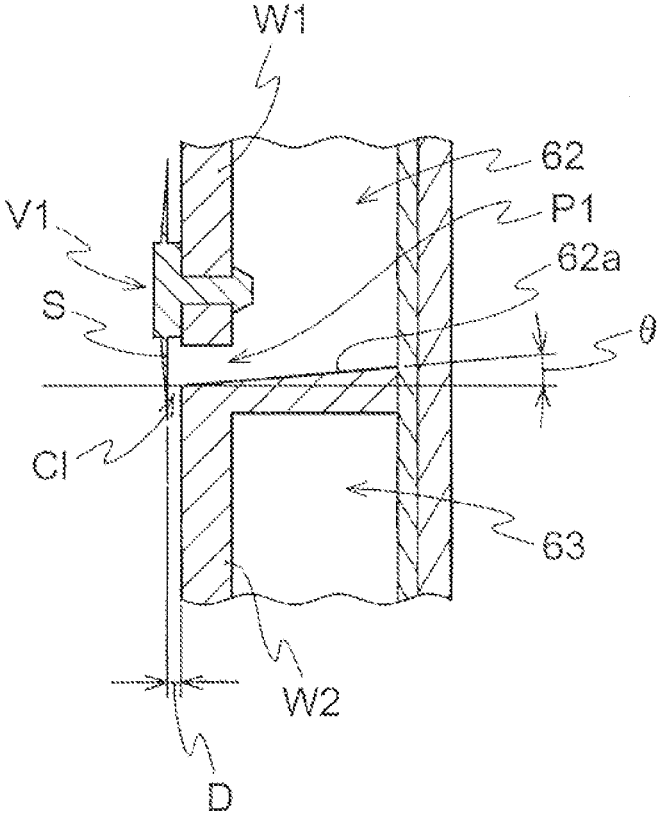

As shown in FIG. 3, an angle 8 of inclination of the bottom portion 62*a* of the suction chamber 62 and the bottom portion of the first communicating passage P1 with respect to a horizontal plane is not limited particularly as far as it is an angle being enough for draining the water flowing in the pump. The water can be drained, for example, by setting the angle 8 of inclination to be 3° or more. Such an angle may be applied not only to the bottom portion 62*a* of the suction chamber 62 but also to the bottom portion 61*a* of the compression chamber 61, the second communicating passage P2, the bottom portion 63*a* of the exhaust chamber 63, and the exhaust port 8. Moreover, a draining effect can be accelerated by forming not only the bottom portion 62*a* of the suction chamber 62 but also the bottom portion 61*a* of the compression chamber 61, the second communicating passage P2, the bottom portion 63*a* of the exhaust chamber 63, and the exhaust port 8 by molding a hydrophobic material, or by applying a hydrophobic coating to the bottom portions thereof, and as a result, the angle 8 of inclination can be made smaller. In FIGS. 1 to 3, the inclined bottom portions of the suction chamber 62, the compression chamber 61 and the exhaust chamber 63 are represented in the form of flat surface, but are not required to be in the form of flat bottom surface. The inclined bottom portions may be in the form of curved surface, or a plurality of inclined portions may be provided in a stepwise form.

The suction port 7 may be sloped down such that the suction chamber 62 side thereof is made lower, or the inlet side thereof may be made lower so that water hardly flows into the suction chamber from the suction port 7.

The relation of the positions of the suction chamber 62, the compression chamber 61 and the exhaust chamber 63 is such that the bottom portion 62*a* of the suction chamber 62 is located at a highest position, next the bottom portion 61*a* of the compression chamber 61 is lower than the bottom portion 62*a* of the suction chamber 62, and the bottom portion 63*a* of the exhaust chamber 63 is lower than the bottom portion 61*a* of the compression chamber 61. When the relation is as mentioned above, water flowing inside the pump is drained from the exhaust port by means of a gravity. Therefore, it goes without saying that as far as the above-mentioned relation of the positions of the respective chambers with respect to the heights thereof is satisfied, it is included in the presently disclosed embodiment.

As shown in FIG. 2, in order to make draining of water more efficient, it is possible to provide a concave portion 62*b* for collecting water having a further steep inclination on the bottom portion 62*a* of the suction chamber 62 being adjacent to the first communicating passage P1. While in FIG. 2, the concave portion 62*b* for collecting water is provided only in the suction chamber 62, however it goes without saying that a similar concave portion like the concave portion 62*b* for collecting water may be provided in the compression chamber 61 and the exhaust chamber 63.

Next, the function of water draining of the presently disclosed embodiment is explained. When an alternating voltage is applied to the electromagnetic coil portion 2, the oscillator 4 provided with the permanent magnets 3 is driven so as to make a reciprocating vibration in the right and left directions in FIG. 1 due to a magnetic action by the electromagnetic coil portion 2. According to the reciprocating vibration of the oscillator 4, the diaphragms 5 connected to the both ends of the oscillator 4 also deflect in the right and left directions, thereby changing the volume of the inside of the compression chamber 61 and increasing or decreasing the inside pressure of the compression chamber 61. For example, when the diaphragm 5 at the right-hand side in FIG. 1 is deflected toward the left and the inside pressure of the compression chamber 61 is decreased, the suction valve V1 opens the first communicating passage P1 and a force for closing the second communicating passage P2 is applied to the exhaust valve V2 to close the second communicating passage P2. On the contrary, when the diaphragm 5 at the right-hand side in FIG. 1 is deflected toward the right, the inside pressure of the compression chamber 61 is increased, the suction valve V1 closes the first communicating passage P1 and the exhaust valve V2 opens the second communicating passage P2.

Accordingly, when water flows in the pump from the suction port 7, water having flowed in the suction chamber 62 moves toward the first communicating passage P1 due to the inclination of the bottom portion 62*a* of the suction chamber 62, and when the oscillator 4 is driven and the suction valve V1 is opened, water flowing in the first communicating passage P1 moves into the compression chamber 61 through the clearance between the opened suction valve V1 and the partition wall W1. Similarly, water having flowed in the compression chamber 61 moves toward the second communicating passage P2 due to the inclination of the bottom portion 61*a* of the compression chamber 61, and when the oscillator 4 is driven and the exhaust valve V2 is opened, water moves into the exhaust chamber 63 through the clearance between the opened exhaust valve V2 and the partition wall W2. Further, water having flowed into the exhaust chamber 63 is drained outside of the pump from the exhaust port 8 due to the inclination of the bottom portion 63*a* of the exhaust chamber 63 and the inclination of the exhaust port 8. As a result, by driving the pump 1, water having flowed into the pump from the suction port 7 can be drained from the exhaust port 8, and thus, no water remains inside the pump casings 6.

The above-mentioned embodiment shows the case where water can be drained when the pump 1 is driven. Meanwhile, as shown in FIG. 3, even while the pump 1 is shut down, water can be drained by providing clearances between the suction valve V1 and the partition wall W1 being a valve seat thereof and between the exhaust valve V2 and the partition wall W2 being a valve seat thereof. Namely, when taking the suction valve V1 as an example, as shown in FIG. 3, the clearance Cl is formed between the suction valve V1 and the partition wall W1 being a valve seat thereof. The suction valve V1 is made of an elastic material. While the pump 1 is not driven and a pressure is not applied to the inside of the compression chamber 61, the skirt portion of the suction valve V1 is in a stationary state as shown in FIG. 3. Therefore, even in the case of the pump 1 being in a shut-down state, when water flows in the pump, water in the suction chamber 62 can be drained in the compression chamber 61 through the clearance Cl.

By providing a clearance between the exhaust valve V2 and the partition wall W2 in the same manner as in the suction valve V1, water can be drained from the compression chamber 61 to the exhaust chamber 63, and even during the shut-down of the pump 1, water having flowed into the pump from the suction port 7 can be drained from the exhaust port 8. Accordingly, it is possible to further prevent deterioration of the members to be provided inside the pump casings 6 and generation of rusting of metal fixing means such as screws inside the pump casings 6.

When the pump 1 is driven and a fluid is taken in from the suction chamber 62 to the compression chamber 61, the suction valve V1 is opened due to a pressure drop in the compression chamber 61, and the skirt portion S of the exhaust valve V2 is drawn toward the partition wall W2 to close the exhaust valve V2. Moreover, when a fluid is exhausted from the compression chamber 61 into the exhaust chamber 63, the exhaust valve V2 is opened due to a pressure drop in the compression chamber 61, and the skirt portion S of the suction valve V1 is pressed onto the partition wall W1 to close the suction valve V1. Accordingly, during the shut-down of the pump 1, water can be drained, and while the pump 1 is driven, the clearance CI is closed and the discharge of the pump 1 can be maintained.

Water can be drained through the clearance CI, and in order not to deteriorate performance of the pump 1, the dimension D of the clearance CI from the skirt portion S of the suction valve V1 to the partition wall W1 being a valve seat thereof is not limited particularly and is preferably from 0.2 to 1.0 mm. When it is less than 0.2 mm, water cannot be drained effectively, and when it is more than 1.0 mm, performance of the pump 1 is decreased.

EXPLANATION OF SYMBOLS

1 Pump
2 Electromagnetic coil portion
3 Permanent magnet
4 Oscillator
5 Diaphragm
6 Pump casing
61 Compression chamber
62 Suction chamber
63 Exhaust chamber
61*a*, 62*a*, 63*a* Bottom portion
62*b* Concave portion for collecting water
7 Suction port
8 Exhaust port
C Casing
Cl Clearance
P1 First communicating passage
P2 Second communicating passage
S Skirt portion
V1 Suction valve
V2 Exhaust valve
W1, W2 Partition wall

The invention claimed is:

1. An electromagnetic vibrating diaphragm pump comprising:

magnetic coil portions connected to an alternating-current power source, an oscillator being equipped with a permanent magnet and being driven so as to make a reciprocating motion by applying an alternating voltage to the magnetic coil portions, diaphragms connected to both ends of the oscillator, and pump casings provided with a suction port and an exhaust port for a fluid, wherein each of the pump casings is provided with:

a suction chamber provided on an upper side of the pump casing and communicating with the suction port, an exhaust chamber provided on a lower side of the pump casing and communicating with the exhaust port, and a compression chamber communicating with the suction chamber via a suction valve and communicating with the exhaust chamber via an exhaust valve, wherein an inside pressure increases and decreases due to deformation of the diaphragm according to the reciprocating motion of the oscillator, wherein a first communicating passage being provided with the suction valve and communicating between the suction chamber and the compression chamber is formed at a bottom end of a partition wall between the suction chamber and the compression chamber, a bottom portion inside the suction chamber slopes down toward the first communicating passage such that the compression chamber side thereof is lower than the suction chamber side, and a bottom portion of the first communicating passage slopes down such that its compression chamber side is made lower, a second communicating passage being provided with the exhaust valve and communicating between the exhaust chamber and the compression chamber is formed at a bottom end of a partition wall between the exhaust chamber and the compression chamber, a bottom portion inside the compression chamber slopes down toward the second communicating passage such that the exhaust chamber side thereof is lower than the compression chamber side, and a bottom portion of the second communicating passage slopes down such that its exhaust chamber side is made lower, and a bottom portion inside the exhaust chamber slopes down toward the exhaust port such that the exhaust port side thereof is made lower, and the exhaust port slopes down such that an outlet side thereof is made lower.

2. The electromagnetic vibrating diaphragm pump of claim 1, wherein a concave portion for collecting water is formed on the bottom portion inside the suction chamber and/or the compression chamber being adjacent to the first communicating passage.

3. The electromagnetic vibrating diaphragm pump of claim 2, wherein the suction valve and/or the exhaust valve are arranged such that a clearance is formed between the valve and the partition wall being a valve seat of the suction valve and/or the exhaust valve.

4. The electromagnetic vibrating diaphragm pump of claim 1, wherein the suction valve and/or the exhaust valve are arranged such that a clearance is formed between the valve and the partition wall being a valve seat of the suction valve and/or the exhaust valve.

* * * * *